US006019190A

United States Patent [19]

Luebrecht et al.

[11] Patent Number: 6,019,190

[45] Date of Patent: Feb. 1, 2000

[54] MOTOR COVER FOR A WORK ASSIST VEHICLE

[75] Inventors: Donald E. Luebrecht, Ft. Jennings; Kevin A. Gilliland, Coldwater; Matthew P. Ranly, Minster; Harold A. Stammen, New Bremen; William J. Heidemann, Sidney; David B. Smith, Worthington, all of Ohio

[73] Assignee: Crown Equipment Corporation, New Bremen, Ohio

[21] Appl. No.: 09/143,004

[22] Filed: Aug. 28, 1998

[51] Int. Cl.[7] ..... E06C 1/00

[52] U.S. Cl. ..... 182/18; 182/148

[58] Field of Search ..... 182/18, 148, 63.1, 182/69.6, 141; 280/43.23

[56] References Cited

U.S. PATENT DOCUMENTS 4,311,208 1/1982 Macrovie ..... 182/18

5,337,859 8/1994 Neubauer ..... 182/148

5,853,065 12/1998 Hutson ..... 182/18

5,875,869 3/1999 Busuttil ..... 182/148

*Primary Examiner*—Alvin Chin-Shue

*Attorney, Agent, or Firm*—Killworth, Gottman, Hagan & Schaeff, L.L.P.

[57] ABSTRACT

A work assist vehicle includes a self propelled, steerable body having a chassis and a drive mechanism supported on the chassis; a mast assembly coupled to the body; and, a personnel compartment attached to the mast assembly and being movable by the mast assembly toward and away from the body. The body further includes a cover adapted to extend over a portion of the chassis and a weight sensor assembly coupled to the chassis and the cover. The weight sensor assembly is capable of detecting if someone or something is located on the cover.

20 Claims, 10 Drawing Sheets

MOTOR COVER FOR A WORK ASSIST VEHICLE

CROSS-REFERENCE TO RELATED APPLICATIONS

This application claims the benefit of U.S. Provisional Application No. 60/057,849, filed Sep. 2, 1997, and entitled MOTOR COVER FOR MATERIALS HANDLING AND MAINTENANCE VEHICLE and U.S. Provisional Application No. 60/060,287, filed Sep. 29, 1997 and entitled MOTOR COVER FOR MATERIALS HANDLING AND MAINTENANCE VEHICLE, both of which are incorporated herein by reference. This application is also related to previously filed U.S. patent applications, Ser. No. 08/725,975, filed Oct. 4, 1996, and Ser. Nos. 09/060,662 and 09/060,661, both filed Apr. 15, 1998, which are also incorporated herein by reference.

BACKGROUND OF THE INVENTION

This invention relates in general to electric powered work assist vehicles that are particularly useful in transporting items retrieved from shelves in a warehouse, or as a work platform which allows an operator to be raised approximately six feet or more from a floor of a work area and, more particularly, to such a vehicle having a weight sensor assembly for detecting if someone or something is located on a portion of the vehicle beneath a vertically movable passenger compartment.

Small parts picking is currently done by personnel manually pushing carts equipped with several shelves and a low level ladder which the operator climbs for reaching stock items up to nine feet high. Higher elevation picking, up to twelve feet, is accomplished with large manual push-in-place mobile ladder stands. Both the carts and mobile ladder stands require the operator to climb up and down while manually holding the goods.

A compact aerial lift vehicle which can be used for parts picking is disclosed in U.S. Pat. No. 5,273,132. The vehicle is separable into several parts for storage and can be controlled by an operator supported upon a platform which can be elevated along a vertical post member removably mounted upon a body of the vehicle. There is no provision for preventing the platform from being lowered onto someone or something located on the body beneath the platform. Such action can injure or damage whatever is on the body or cause harm to the platform and/or the vehicle body if the platform is allowed to be lowered. Injury, damage or harm can also result if the vehicle travels in this situation.

Accordingly, there is a need for an improved work assist vehicle which includes means for detecting if something or someone is located on a portion of a body of the vehicle.

SUMMARY OF THE INVENTION

The present invention is directed to a multi-task capable work assist vehicle designed for transporting and elevating an operator with goods or equipment. Its uses include order picking, in-house service maintenance, stock management, cargo delivery, and the like. It is designed to be compact in size to be highly maneuverable for use in narrow storage aisles and tight quarters.

In accordance with a first aspect of the present invention, a work assist vehicle comprises: a self propelled, steerable body including a chassis and a drive mechanism supported on the chassis; a mast assembly coupled to the body; and, a personnel compartment attached to the mast assembly and being movable by the mast assembly toward and away from the body. The body further includes a cover adapted to extend over a portion of the chassis and a weight sensor assembly coupled to the chassis and the cover. The weight sensor assembly is capable of detecting if someone or something is located on the cover. The body further comprises a controller.

The weight sensor assembly may comprise a support bar coupled to the chassis so as to be movable relative to the chassis. The cover is coupled to the support bar so as to move with the support bar. At least one spring is positioned between the support bar and the chassis for biasing the support bar away from the chassis. At least one microswitch is coupled to the chassis and positioned adjacent the support bar. The at least one microswitch is activated by the support bar if the support bar is moved against the at least one spring toward the chassis by someone or something located on the cover. The at least one microswitch generates a presence-detected signal when activated and the presence-detected signal is coupled to the controller.

In accordance with a second aspect of the present invention, a vehicle comprises: a self propelled, steerable body including a chassis and a drive mechanism supported on the chassis; a mast assembly coupled to the body; and a base attached to the mast assembly and being movable by the mast assembly toward and away from the body. The body further includes a cover adapted to extend over a portion of the chassis and a weight sensor assembly coupled to the chassis and the cover. The weight sensor assembly is capable of detecting if someone or something is located on the cover.

It is, thus, an object of the invention of the present application to provide a sensing arrangement for sensing if someone or something is located on a portion of a work assist vehicle and may be injured or damaged by or cause harm to the vehicle if operation of the vehicle continues.

Other objects and advantages of the invention will be apparent from the following description, the accompanying drawings and the appended claims.

DETAILED DESCRIPTION OF PREFERRED EMBODIMENTS

Figure 1:
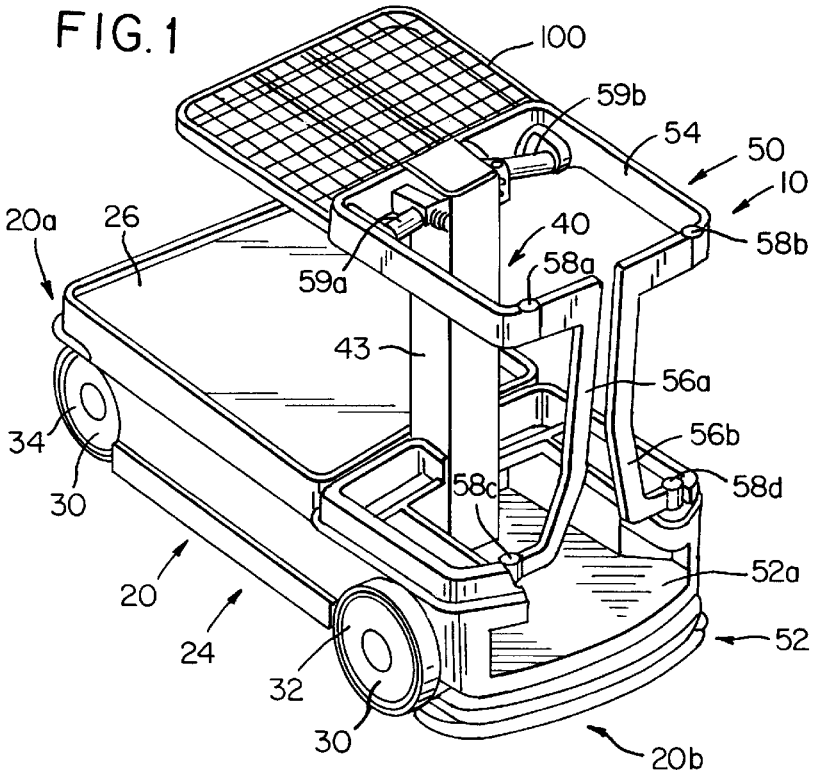
FIG. 1 is a perspective view of a work assist vehicle including the invention of the present application.

A work assist vehicle 10 constructed in accordance with the present invention is illustrated in FIGS. 1–6. It includes a self-propelled, steerable body 20 having a front 20*a* and a rear 20*b*. The body 20 comprises a chassis 24 and a drive mechanism 30 supported on the chassis 24. The drive mechanism 30 includes a pair of drive wheels 32 mounted near the rear 20*b* of the body 20, and a pair of caster wheels 34 mounted near the front 20*a* of the body 20. A load deck or platform 26 is removably attached to the chassis 24.

Figure 2:
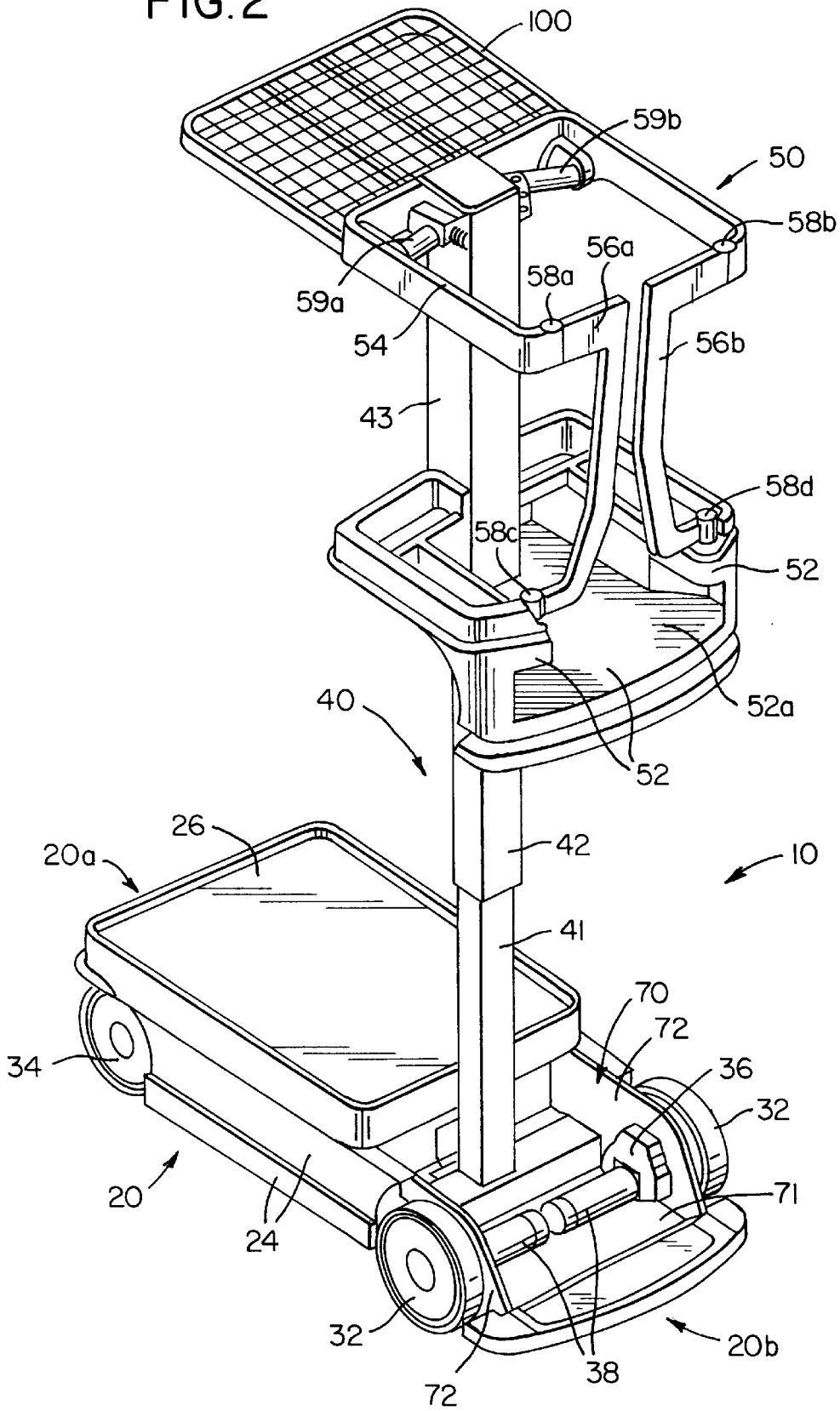
FIG. 2 is a perspective view of the vehicle of FIG. 1 with the operator's platform or compartment in the raised position.
Figure 4:
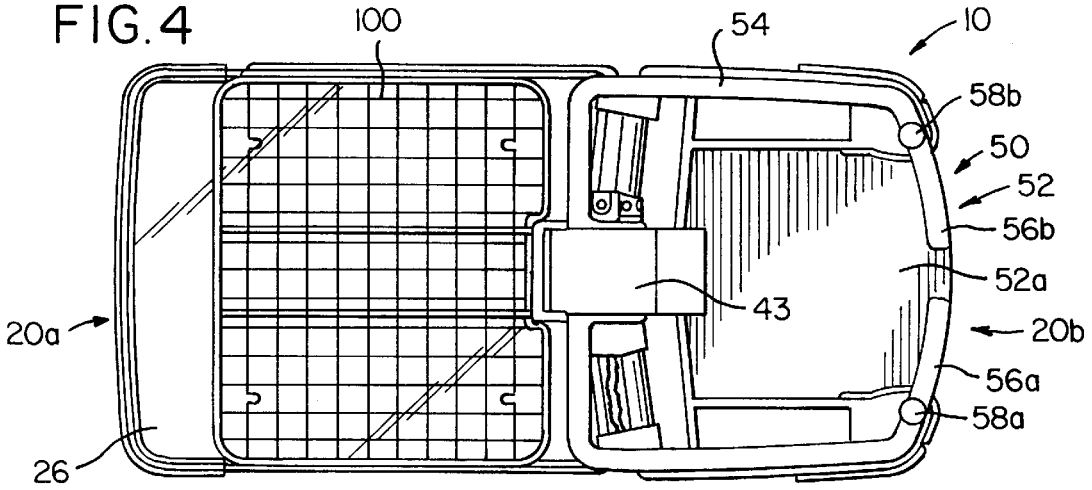
FIG. 4 is a plan view of the vehicle shown in FIG. 1.
Figure 5:
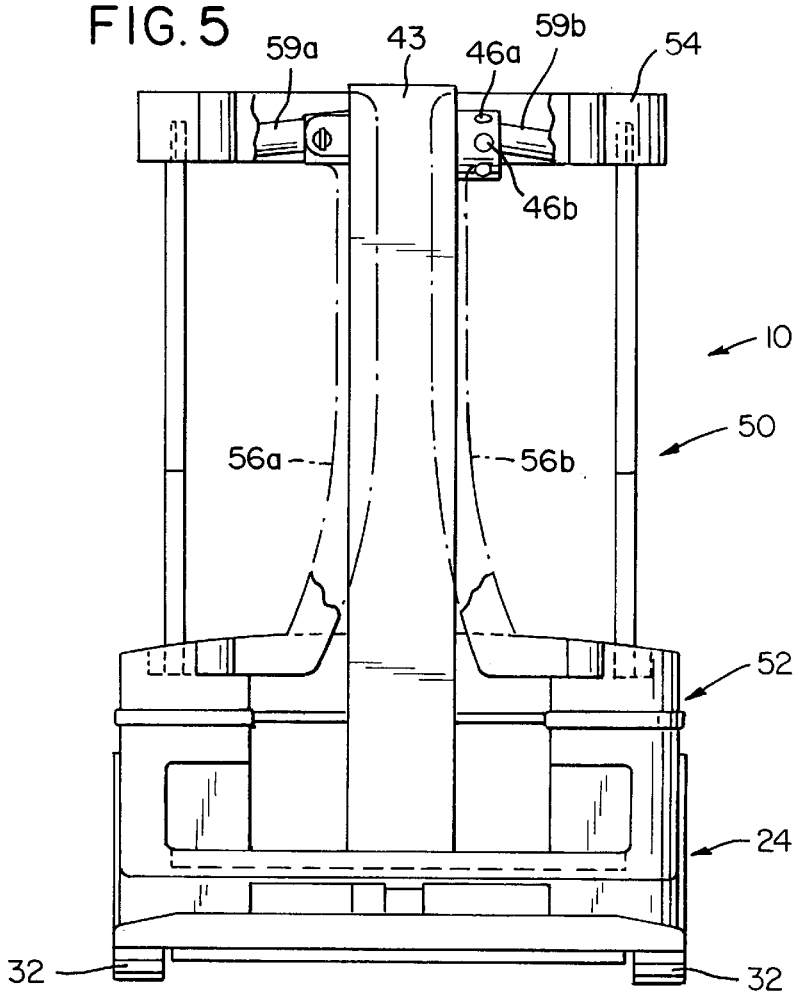
FIG. 5 is a rear elevational view of the vehicle with the operator's compartment in its lowermost position and with a portion of the vehicle shown in phantom.
Figure 14:
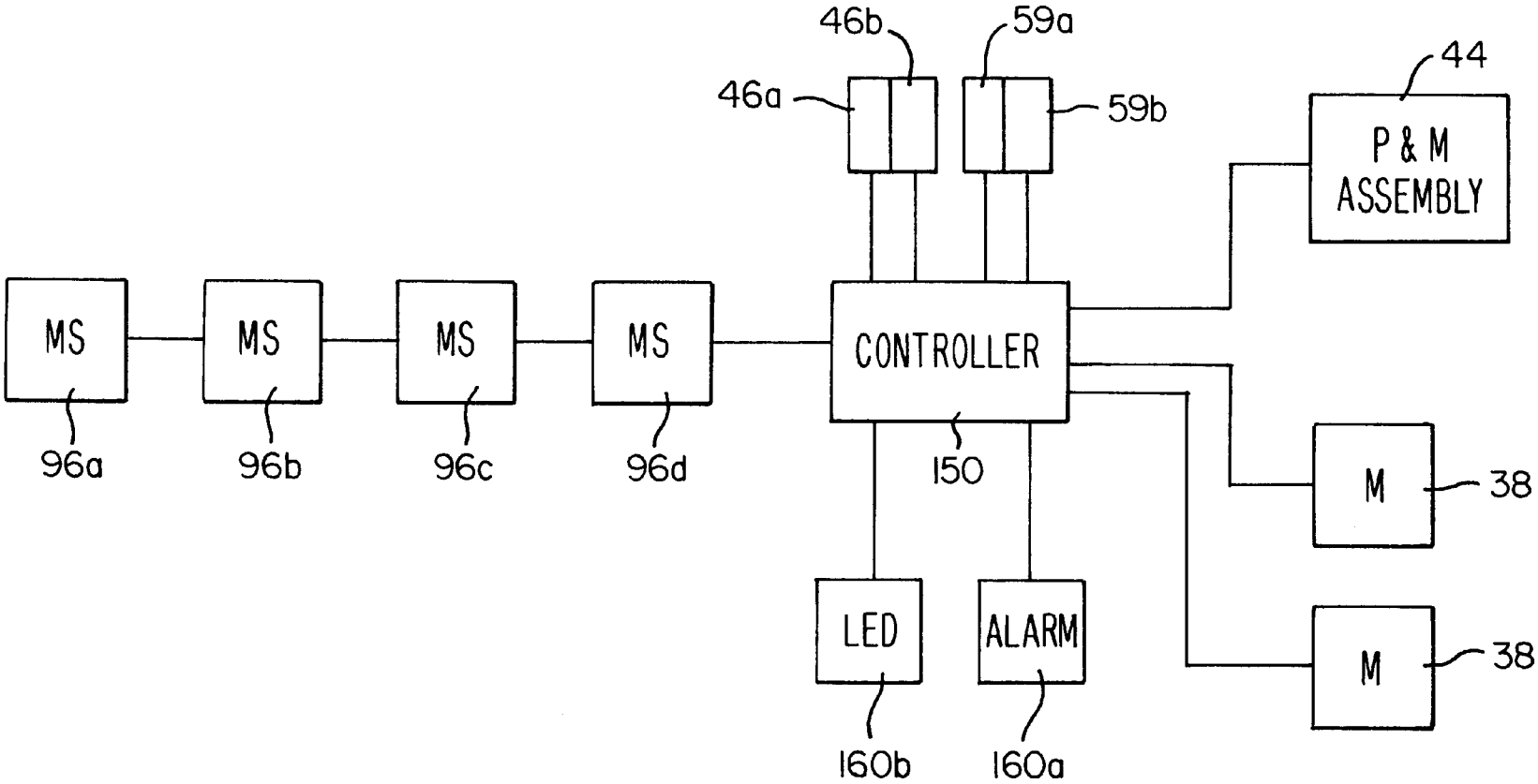
FIG. 14 is a simplified electrical schematic of a control circuit used in the present invention.

A mast assembly 40 is coupled to the body 20. As shown in FIG. 2, the mast assembly 40 includes three nested sections 41, 42, and 43. It further includes an elevating device for effecting extension and retraction of the sections 42 and 43. The elevating device comprises a hydraulic cylinder (not shown) coupled to a hydraulic pump and motor assembly 44 which, in turn, is coupled to a vehicle controller 150, see FIG. 14. Push button switches 46*a* and 46*b* are provided, see FIG. 5, and are coupled to the controller 150, see FIG. 14. Upon actuation of the switch 46*a*, the elevating device extends the mast sections 42 and 43 from their retracted positions, see FIGS. 1 and 3, to their fully extended positions, shown in FIGS. 2 and 6. When the switch 46*b* is activated, the elevating device retracts the sections 42 and 43. While three mast sections are illustrated, the number of mast sections actually used may vary.

An operator's or personnel compartment 50 is attached to the mast assembly 40, and specifically to the outer or upper mast section 43. Hence, the compartment 50 moves with the upper mast section 43. The compartment 50 includes a base 52 removably attached to the mast section 43, a rail member 54 mounted to the mast section 43 and extending around the sides and front of the personnel compartment 50, and a pair of gate members 56*a* and 56*b* pivotally attached to the rail member 54 at 58*a* and 58*b*, respectively, and to the base 52 at 58*c* and 58*d*, respectively. The gate members 56*a* and 56*b* are movable from a closed position, as shown in FIG. 1, to an open position wherein the gate members 56*a* and 56*b* extend into the personnel compartment 50. As shown in FIGS. 1 and 2, the base 52 includes a floor 52*a* upon which an operator 60 stands.

Figure 3:
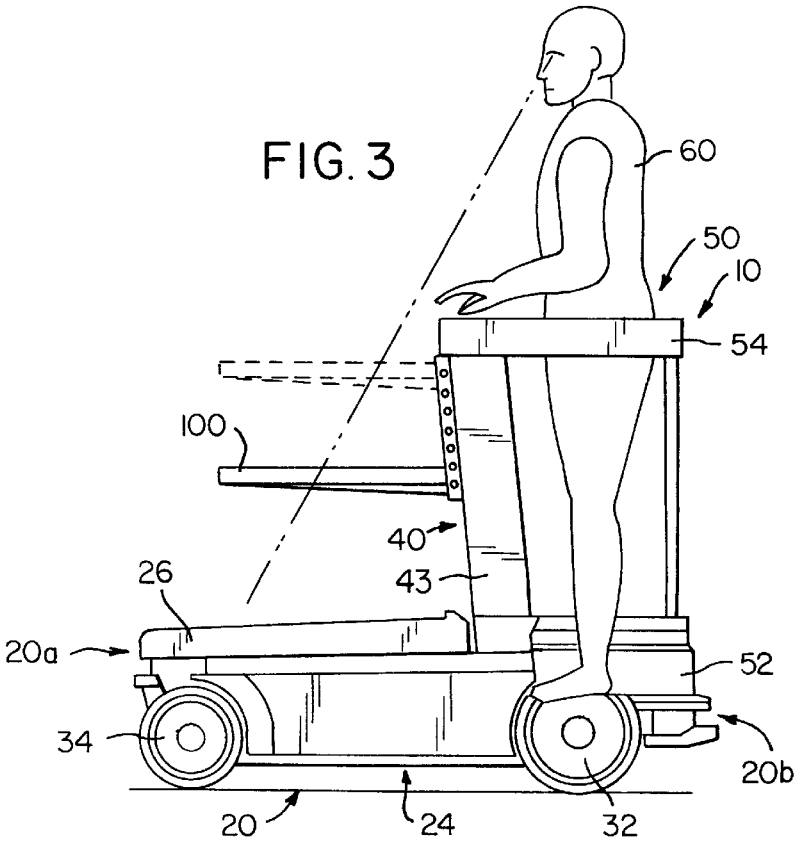
FIG. 3 is a side elevational view of the vehicle shown in FIG. 1.
Figure 6:
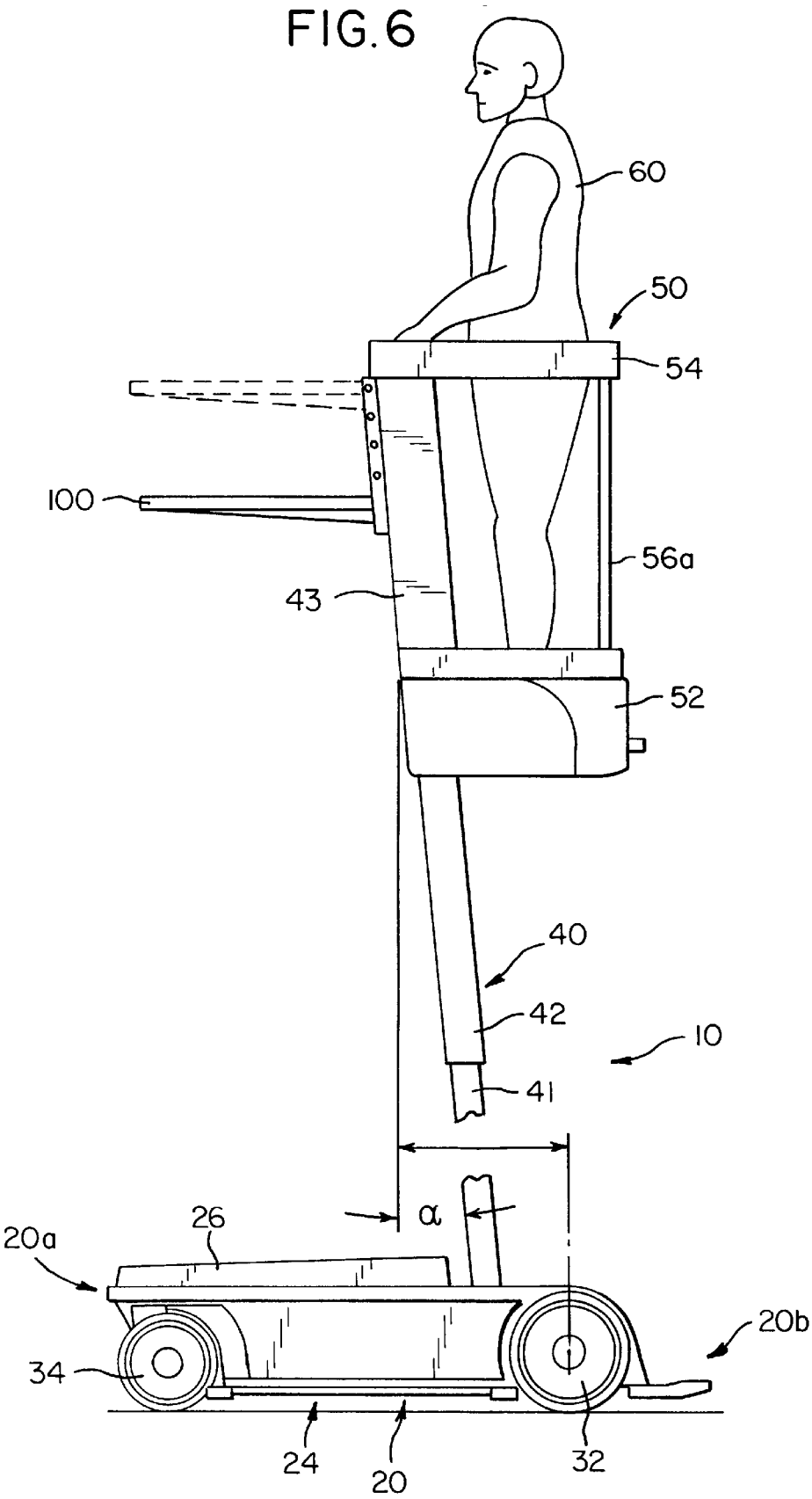
FIG. 6 is a side elevational view of the vehicle with the operator's compartment in the raised position.

As shown in FIGS. 3 and 6, the rail member 54, as well as the top of the mast section 43, is placed approximately waist height of an operator 60 standing within the personnel compartment 50. The mast assembly 40 does not extend above the rail member 54 in the illustrated embodiment, thus giving the operator 60 unobstructed access to anything above the top edge of the rail member 54.

As shown in FIG. 6, the lower mast section 41 is attached to the body 20 and extends upwardly and forward of the vehicle at an angle $\alpha$ of approximately 5° from vertical. Hence, as the mast sections 42 and 43 are extended, the personnel compartment 50 is moved upwardly and forwardly. The personnel compartment 50 benefits by the 5° tilt of the mast assembly 40 in that the upper portion of the compartment 50, near the waist of the operator 60, is larger than the floor, thus accommodating the operator 60 comfortably without increasing the length of the vehicle 10.

A removable load tray 100 may be mounted on the mast section 43 to assist the operator 60 as materials are picked from shelves, or in holding materials to be used during maintenance.

The personnel compartment 50 includes a pair of control handles, namely, a steering control handle 59*a* and a traction control handle 59*b*, see FIG. 1. The control handles 59*a* and 59*b* are coupled to the controller 150, see FIG. 14. When the vehicle 10 is in operation, the operator 60 must have one hand on the steering control handle 59*a* and the other hand on the traction control handle 59*b*. This ensures that the operator's hands are within the personnel compartment 50 when the vehicle 10 is being moved or during lifting or lowering operations.

The chassis 24 includes a traction motor compartment 70 which is located directly beneath the personnel compartment 50. In FIGS. 2, 8, 10 and 12, a motor cover 80, which normally encloses the traction motor compartment 70, has been removed to reveal the contents of the compartment 70. Also in FIG. 2, a weight sensor assembly 90, which will be discussed in detail below, has been removed. The traction motor compartment 70 comprises a floor 71 and a pair of side walls 72.

The drive mechanism 30 further includes two gear boxes 36 and two electric traction motors 38. The gear boxes 36 couple the wheels 32 to the motors 38. The motors 38 are connected to the controller 150 which, in turn, is connected to the steering control handle 59*a* and traction control handle 59*b*, see FIG. 14. The controller 150 controls the operation of the motors 38 in response to signals generated by the handles 59*a* and 59*b*.

The gear boxes 36 are mounted on the side walls 72 of the motor compartment 70 and the motors 38 are mounted to the gear boxes 36. The center axis of each of the traction motors 38 is below the center axes of the wheels 32, thus permitting the floor 52*a* of the personnel compartment 50 to be lowered as close to ground level as possible, at a height approximately seven inches above the floor.

The weight sensor assembly 90 is located in the motor compartment 70, see FIGS. 8 and 10–12. It comprises a support bar 92 comprising a generally H-shaped portion 92*a* and a pair of vertically extending side portions 92*b*. The motor cover 80 is connected to the support bar 92, as will be discussed in further detail below. The bar 92 is supported on four springs 94 surrounding a like number of bolts 95. The bolts 95 pass through openings in brackets 92*c* weldably or otherwise fixedly coupled to the H-shaped portion 92*a* and are threadedly coupled to the motor compartment floor 71. The bar 92 is biased away from the floor 71 by the springs 94 but is capable of moving against the force of the springs toward the floor 71 when acted upon by a downward force. First, second, third and fourth positive-acting-normally-closed microswitches 96*a*–96*d* are fixedly coupled to the floor 71 and positioned directly beneath the H-shaped bar 92. The microswitches 96*a*–96*d* are connected to the vehicle controller 150, see FIG. 14. When the bar 92 is depressed toward the floor 71, it activates one or more of the microswitches 96*a*–96*d*.

Figure 7:
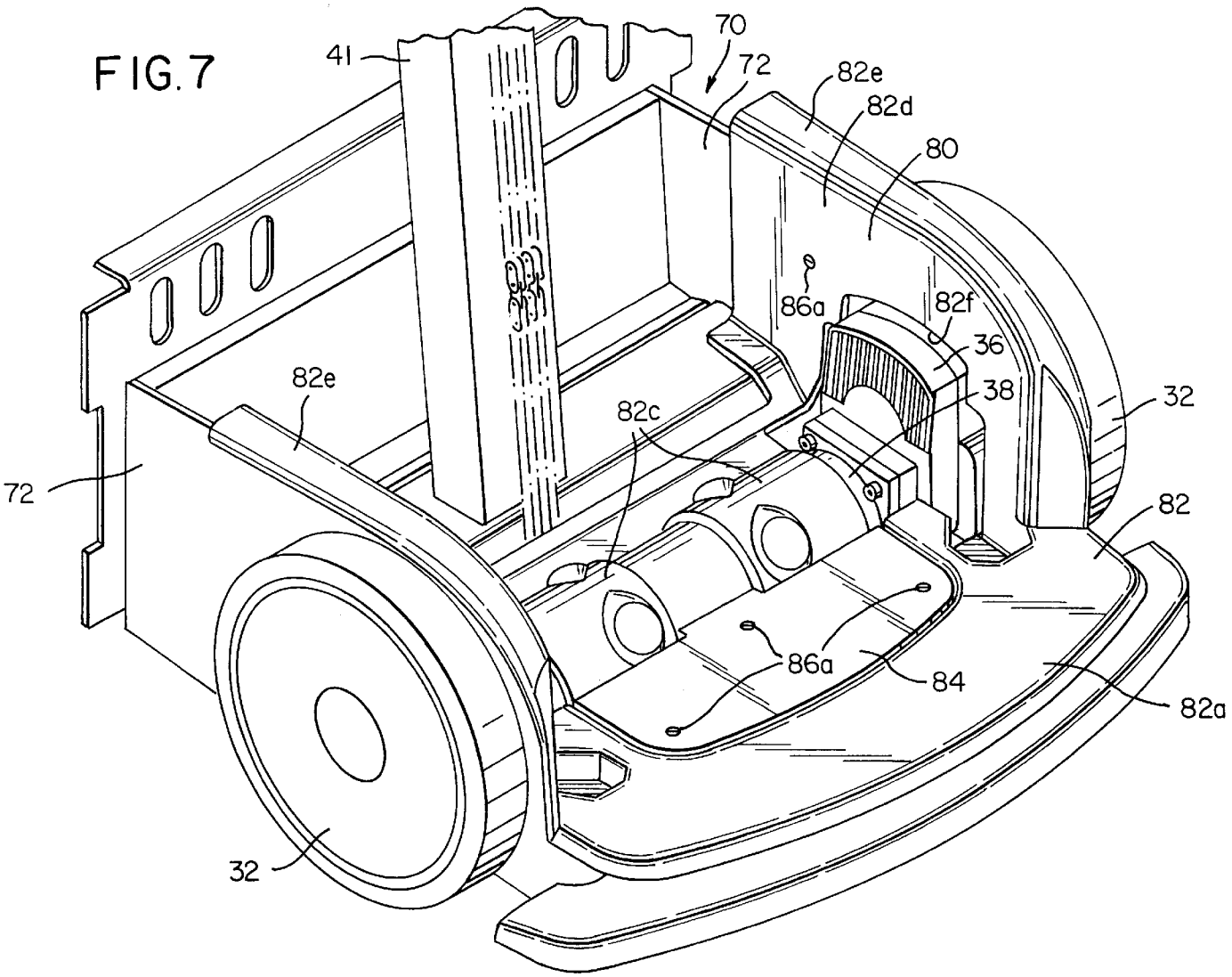
FIG. 7 is a perspective view of the drive motor compartment (the operator's compartment being in the raised position) with the motor cover installed.
Figure 8:
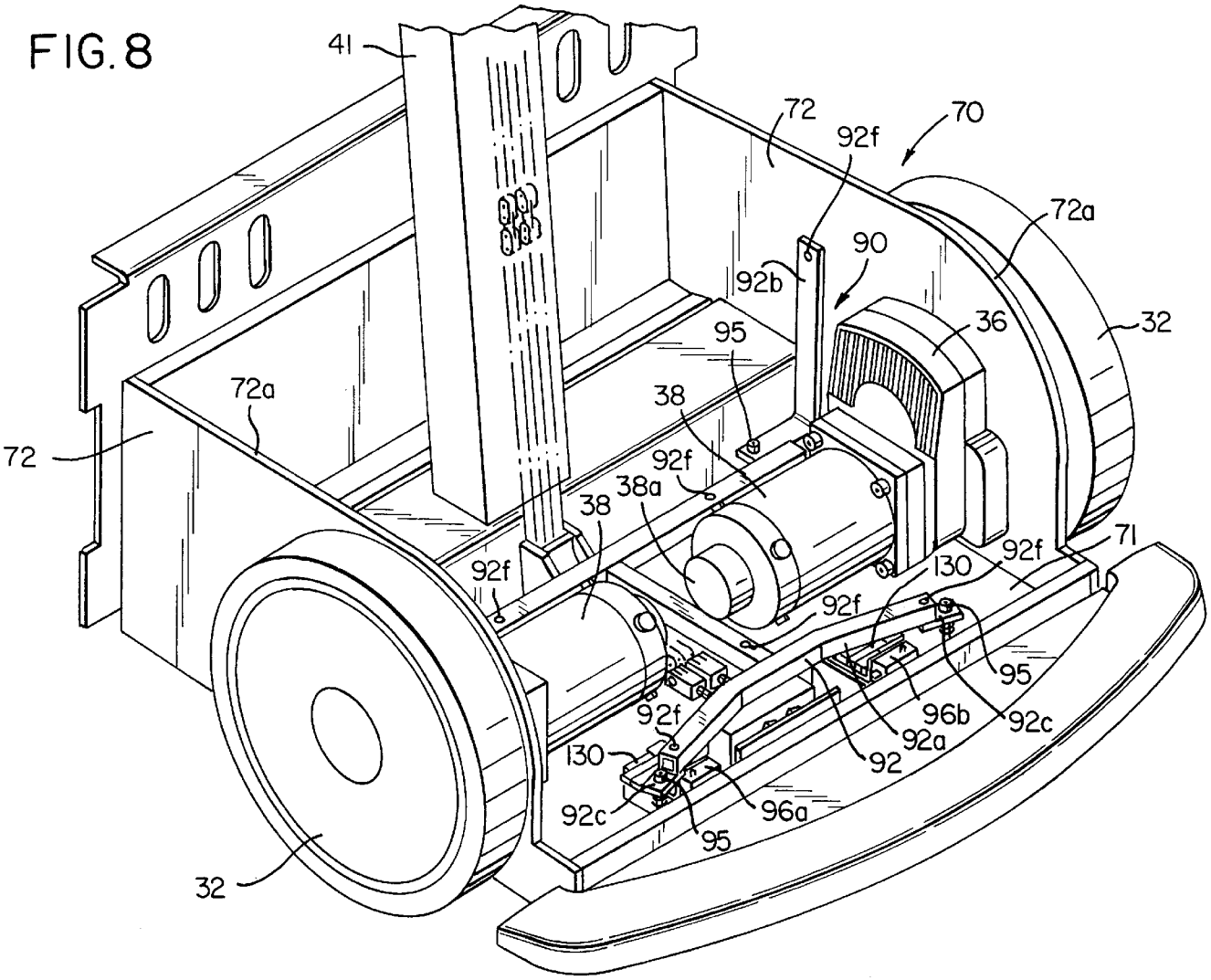
FIG. 8 is a perspective view of the drive motor compartment (the operator's compartment being in the raised position) with the motor cover removed.
Figure 9:
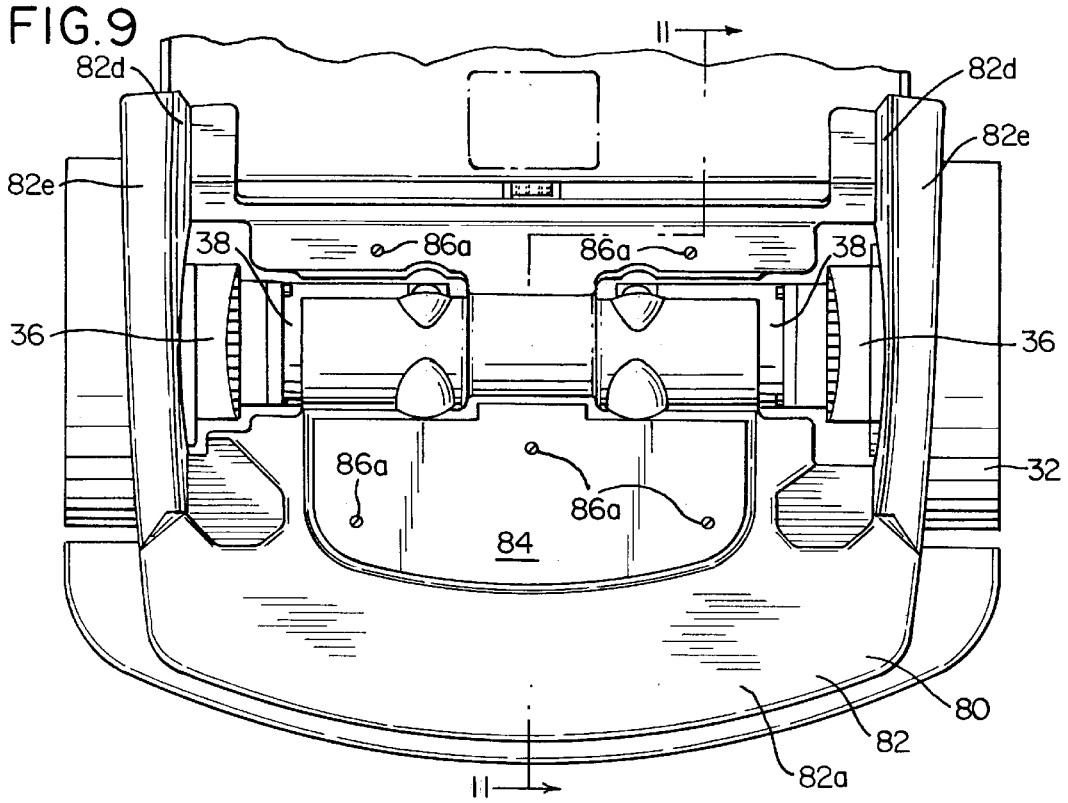
FIG. 9 is a plan view of the motor compartment with the motor cover installed.
Figure 11:
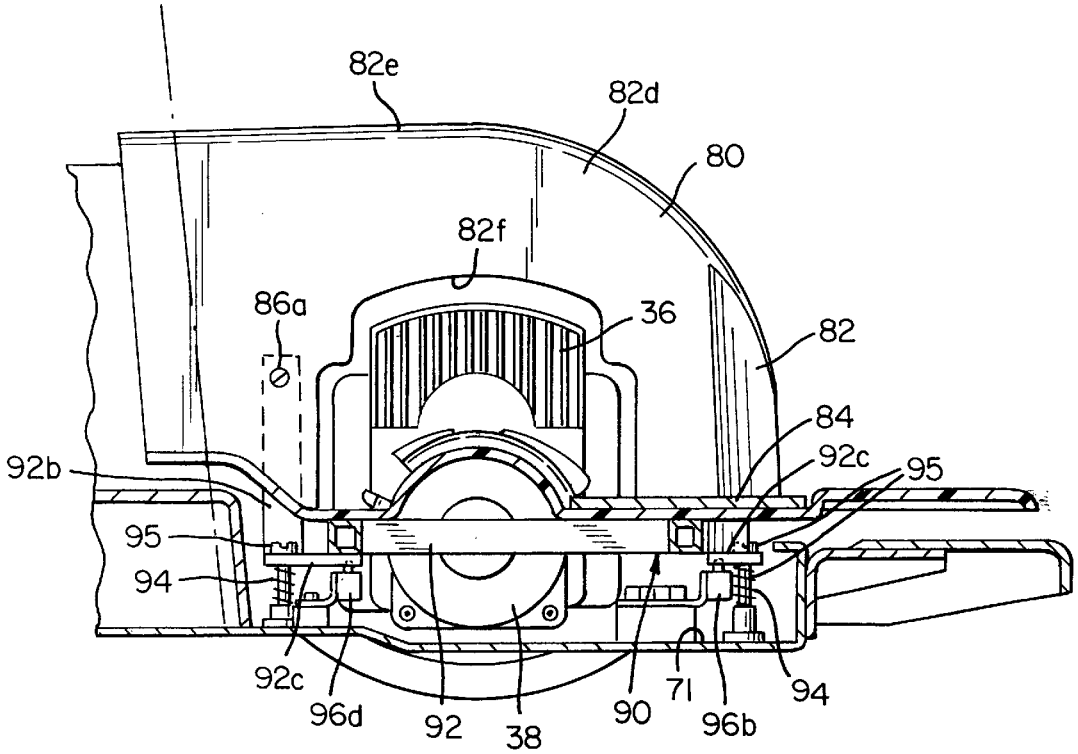
FIG. 11 is a view taken along view line 11—11 in FIG. 9.
Figure 12:
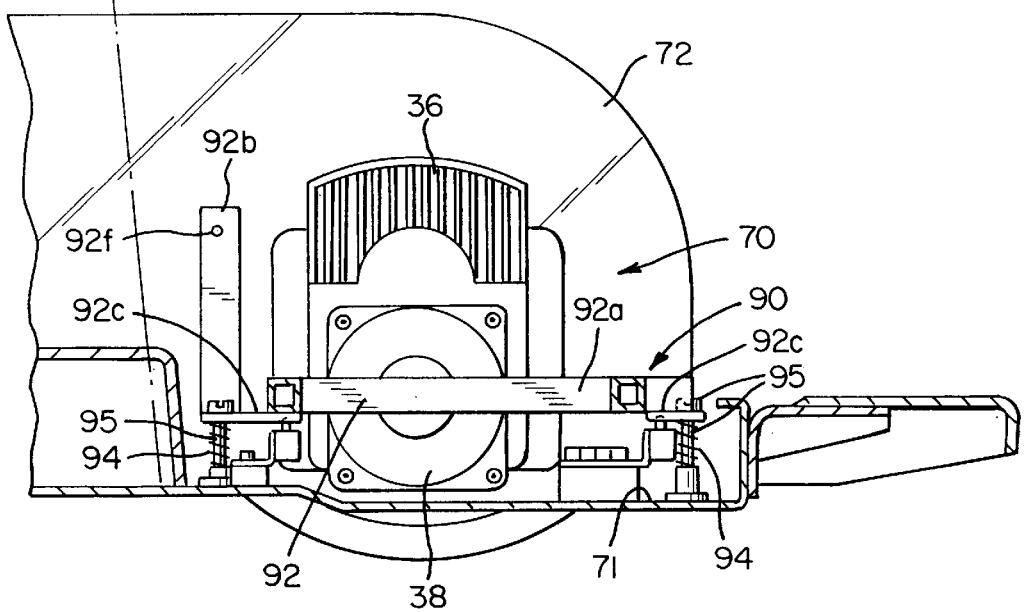
FIG. 12 is a view taken along view line 12—12 in FIG. 10.
Figure 13:
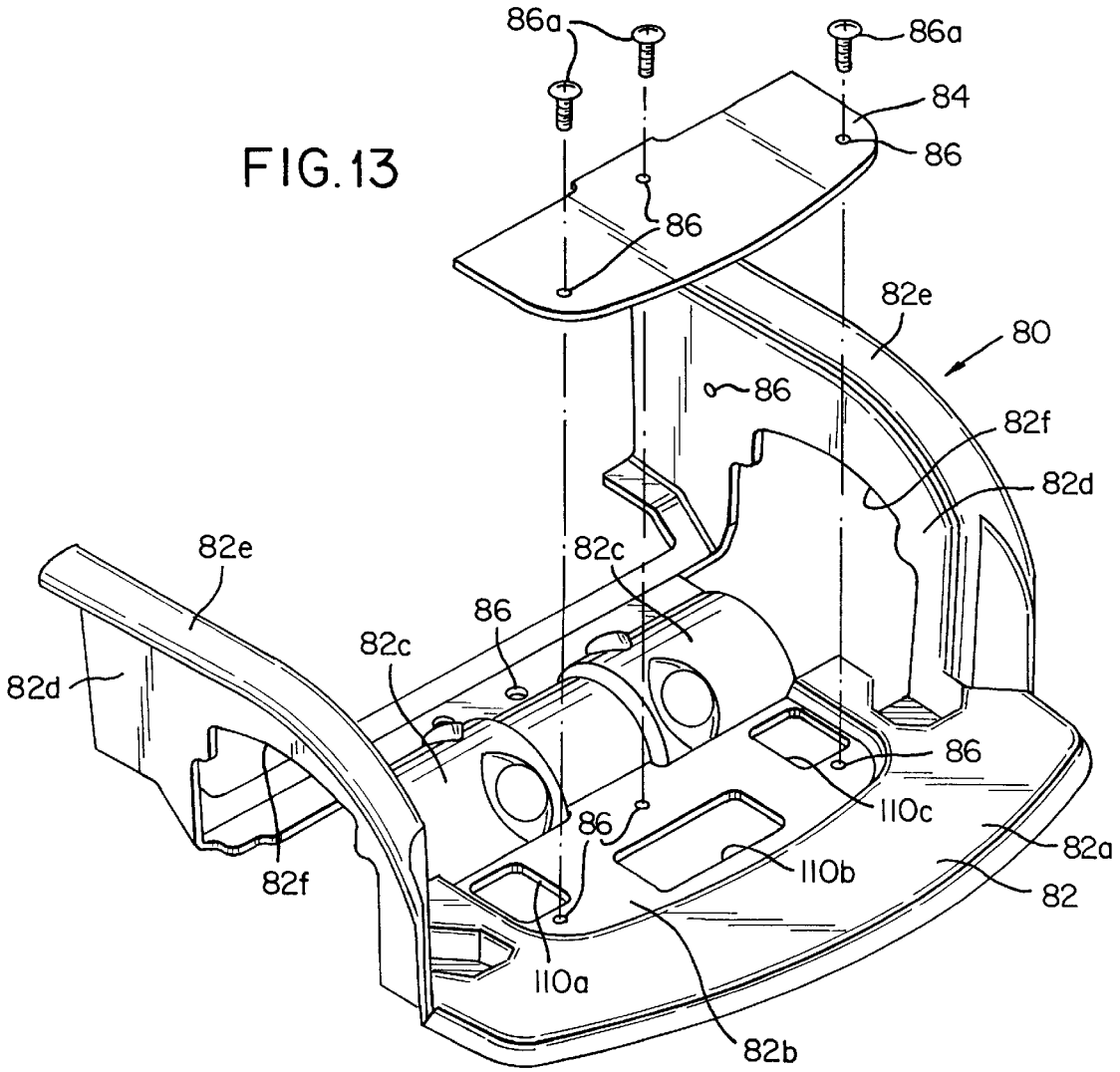
FIG. 13 is an exploded, perspective view of the motor cover.

As noted above, the motor cover 80 encloses the motor compartment 70, see FIGS. 7, 9 and 11. The cover 80 includes a main body portion 82 and an access panel 84, see also FIG. 13. Both the main body portion 82 and the access panel 84 are formed of molded plastic. The main body portion 82 includes a floor area 82*a*, a recessed area 82*b* provided with three openings 110*a*, 110*b* and 110*c*, a pair of semi-cylindrical motor cover elements 82*c*, vertical panels

82*d* with generally horizontal flange portions 82*e* to cover upper edges 72*a* of the motor compartment side walls 72, and openings 82*f* to accommodate the gear boxes 36. The access panel 84 covers the recessed area 82*b*. Openings 86 are provided in the vertical panels 82*d*, the floor area 82*a*, the recessed area 82*b* and the access panel 84 so as to allow bolts 86*a* to pass therethrough and threadedly engage openings 92*f* in the bar 92. The cover 80 is connected only to the bar 92 such that it moves towards and away from the floor 71 with the bar 92.

Figure 10:
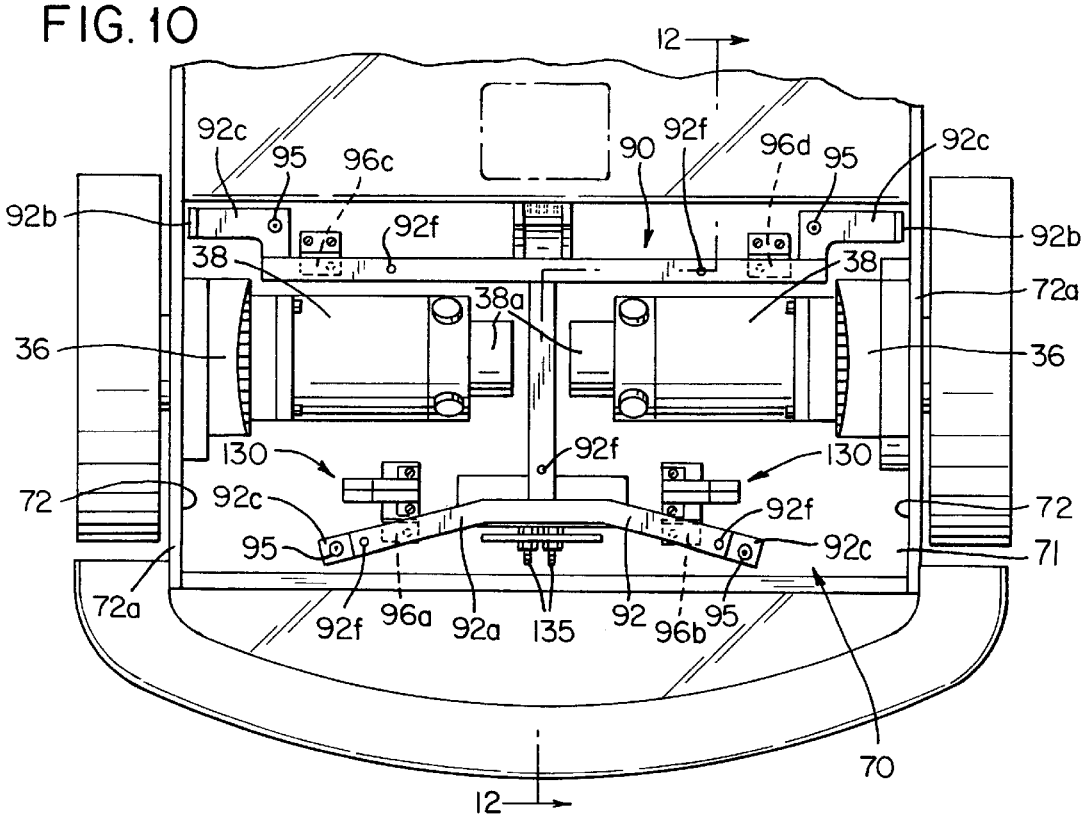
FIG. 10 is a plan view of the motor compartment with the motor cover removed.

The openings 110*a* and 110*c* provide access to traction motor electrical power disconnect blocks 130 while the opening 110*b* provides access to chain tensioning screws 135, see FIG. 10. The recess 82*b*, and the openings 110*a*–110*c*, are covered by the access panel 84.

As shown in FIG. 11, the vertical space between the motor cover 80 and the components in the traction motor compartment 70 is kept at a minimum, in order to ensure that the floor 52*a* of the personnel compartment 52 does not make contact with the motor cover 80.

If someone or something, e.g., a tool, a telephone book, a part, a package or the like, is placed or becomes positioned on the motor cover 80, the weight of the someone or something causes the motor cover 80 and the bar 90 to depress, activating one or more of the microswitches 96*a*–96*d*. The switches 96*a*–96*d* are connected in series and to the vehicle controller 150, see FIG. 14. If any one of the microswitches 96*a*–96*d* is activated as a result of someone or something being located on the cover 80, then vehicle movement and the passenger compartment lowering finction are inhibited by the vehicle controller 150. More specifically, if one or more of the microswitches 96*a*–96*d* is activated, the controller 150 prevents the elevating device from lowering the passenger compartment 50 when the operator 60 actuates the switch 46*b*. It also causes the vehicle 10, if in motion, to be brought to a stop by regeneration, that is, causing the motors 38 to act as generators and return power to batteries (not shown) which also form part of the drive mechanism. Once the vehicle 10 is no longer moving, the controller 150 causes active brakes 38*a*, coupled to the motors 38, to be engaged, see FIGS. 8 and 10. The raise function will not be inhibited but will remain active. An alarm 160*a* will also be sounded and a LED lamp 160*b* will flash as long as one of the microswitches 96*a*–96*d* remains activated, indicating a fault condition. Upon removal of the fault (removal of someone or something on the cover), the vehicle 10 will function normally without requiring a key reset, however, the lowering function will not be immediately restored, but will be fully restored after a delay period, such as a 7.5 second delay.

While the form of apparatus herein described constitutes a preferred embodiment of this invention, it is to be understood that the invention is not limited to this precise form of apparatus and that changes may be made therein without departing from the scope of the invention.

What is claimed is:

1. A work assist vehicle comprising:

a self propelled, steerable body including a chassis and a drive mechanism supported on said chassis;

a mast assembly coupled to said body;

a personnel compartment attached to said mast assembly and being movable by said mast assembly toward and away from said body; and said body further including a cover adapted to extend over a portion of said chassis and a weight sensor assembly coupled to said chassis and said cover, said weight sensor assembly being capable of detecting if someone or something is located on said cover.

2. A work assist vehicle as set forth in claim 1, wherein said chassis portion comprises a motor compartment which is located directly beneath said personnel compartment.

3. A work assist vehicle as set forth in claim 1, wherein said mast assembly comprises two or more mast sections and an elevating device coupled to said chassis and at least one of said mast sections, said elevating device causing said at least one mast section to move toward and away from said chassis, and said at least one mast section being coupled to said personnel compartment such that said compartment moves with said one mast section.

4. A work assist vehicle as set forth in claim 3, wherein said body further comprises a controller.

5. A work assist vehicle as set forth in claim 4, wherein said weight sensor assembly comprises:

a support bar coupled to said chassis and being movable relative to said chassis, said cover being coupled to said support bar;

at least one spring positioned between said support bar and said chassis for biasing said support bar away from said chassis; and at least one microswitch coupled to said chassis and positioned adjacent said support bar, said at least one microswitch being activated by said support bar if said support bar is moved against said at least one spring toward said chassis by someone or something located on said cover, said at least one microswitch generating a presence-detected signal if activated, said presence-detected signal being coupled to said controller.

6. A work assist vehicle as set forth in claim 5, wherein said support bar comprises a generally H-shaped bar.

7. A work assist vehicle as set forth in claim 6, wherein said at least one microswitch comprises first, second, third and fourth microswitches positioned beneath said generally H-shaped bar.

8. A work assist vehicle as set forth in claim 5, wherein said controller, upon receiving said presence-detected signal, prevents said elevating device from lowering said personnel compartment toward said chassis.

9. A work assist vehicle as set forth in claim 8, wherein said drive mechanism comprises at least one drive wheel and at least one drive motor assembly coupled to and adapted to drive said at least one drive wheel, said controller preventing said drive motor assembly from driving said at least one drive wheel upon receiving said presence-detected signal.

10. A work assist vehicle as set forth in claim 9, wherein said drive motor assembly includes a brake, said controller causing said brake to be engaged upon receiving said presence-detected signal.

11. A work assist vehicle as set forth in claim 10, wherein said microswitch is deactivated when said object is removed from said cover, said controller permitting said elevating device to lower said personnel compartment toward said chassis a predetermined delay period following deactivation of said at least one microswitch.

12. A vehicle comprising:

a self propelled, steerable body including a chassis and a drive mechanism supported on said chassis;

a mast assembly coupled to said body;

a base attached to said mast assembly and being movable by said mast assembly toward and away from said body; and said body further including a cover adapted to extend over a portion of said chassis and a weight sensor assembly coupled to said chassis and said cover, said weight sensor assembly being capable of detecting if someone or something is located on said cover.

13. A vehicle as set forth in claim 12, wherein said chassis portion comprises a compartment which is located directly beneath said base.

14. A vehicle as set forth in claim 12, wherein said mast assembly comprises two or more mast sections and an elevating device coupled to said chassis and at least one of said mast sections, said elevating device causing said at least one mast section to move toward and away from said chassis, and said at least one mast section being coupled to said base such that said base moves with said one mast section.

15. A vehicle as set forth in claim 14, wherein said body further comprises a controller.

16. A vehicle as set forth in claim 15, wherein said weight sensor assembly comprises:

a support bar coupled to said chassis and being movable relative to said chassis, said cover being coupled to said support bar;

at least one spring positioned between said support bar and said chassis for biasing said support bar away from said chassis; and at least one microswitch coupled to said chassis and positioned adjacent said support bar, said at least one microswitch being activated by said support bar if said support bar is moved against said at least one spring toward said chassis by someone or something located on said cover, said at least one microswitch generating a presence-detected signal if activated, said presence-detected signal being transmitted to said controller.

17. A vehicle as set forth in claim 16, wherein said controller, upon receiving said presence-detected signal, prevents said elevating device from lowering said base toward said chassis.

18. A vehicle as set forth in claim 17, wherein said drive mechanism comprises at least one drive wheel and at least one drive motor assembly coupled to and adapted to drive said at least one drive wheel, said controller further preventing said drive motor assembly from driving said at least one drive wheel upon receiving said presence-detected signal.

19. A vehicle as set forth in claim 18, wherein said drive motor assembly includes a brake, said controller causing said brake to be engaged upon receiving said presence-detected signal.

20. A vehicle as set forth in claim 19, wherein said microswitch is deactivated when said object is removed from said cover, said controller permitting said elevating device to lower said base toward said chassis a predetermined delay period following deactivation of said at least one microswitch.

* * * * *